United States Patent [19]

Suzuki

[11] Patent Number: 4,866,825

[45] Date of Patent: Sep. 19, 1989

[54] APPARATUS FOR CUTTING DOWN FINISHED SLIDE FASTENERS

[75] Inventor: Yasutoshi Suzuki, St-Laurent, Canada

[73] Assignee: Yoshida Kogyo K. K., Tokyo, Japan

[21] Appl. No.: 137,949

[22] Filed: Dec. 28, 1987

[30] Foreign Application Priority Data

Dec. 28, 1986 [JP] Japan ..... 61-201068

[51] Int. Cl.[4] ..... A41H 37/06; B21D 53/50; B23P 23/00

[52] U.S. Cl. ..... 29/33.2; 29/408; 29/566.1; 29/767; 29/770; 83/921

[58] Field of Search ..... 29/33.2, 408, 409, 410, 29/565, 566, 566.1, 766, 767, 768, 769, 770; 83/921; 24/381

[56] References Cited

U.S. PATENT DOCUMENTS 3,872,571 3/1975 Douri ..... 29/33.2
4,381,593 5/1983 Yoshieda et al. ..... 29/408

FOREIGN PATENT DOCUMENTS 57-61409 12/1982 Japan .
1444234 7/1976 United Kingdom ..... 83/921
2130298 5/1984 United Kingdom ..... 29/408

*Primary Examiner*—Bruce Y. Arnold
*Assistant Examiner*—Ronald M. Kachmarik
*Attorney, Agent, or Firm*—Hill, Van Santen, Steadman & Simpson

[57] ABSTRACT

An apparatus for cutting down or reducing the length of a finished slide fastener includes a pilot pin disposed immediately adjacent to the rear end of an element clamper and spaced from the rear end of an element cutter by a distance which is equal to the sum of the element pitch of a row of coupling elements and at least a half of the diameter of a monofilament constituting the row of coupling elements. With the pilot pin thus arranged, a length of coupling elements can be removed smoothly without the occurance of draw of a half-cut coupling element. The apparatus also includes a stopper disposed rearwardly of a top end-stop applicator and engageable with a bottom end stop of the slide fastener for setting the length of reduction from the slide fastener.

5 Claims, 4 Drawing Sheets

APPARATUS FOR CUTTING DOWN FINISHED SLIDE FASTENERS

BACKGROUND OF THE INVENTION

1. Field of the Invention

The present invention relates to an apparatus for cutting down or reducing the length of a finished slide fastener.

2. Description of the Prior Art

In the manufacture of slide fasteners, it sometimes becomes necessary to cut down or reduce the length of the finished slide fasteners in view of the size of articles to which the slide fasteners are to be attached. In such instance, new top end stops are applied to two opposed stringers of a finished slide fastener in view of the length of a desired slide fastener. Then the slide fastener stringers are severed with a group of successing coupling elements left between each of the new top end stops and a line of severance. Thereafter, the remaining coupling elements are removed from the stringers, thereby producing a slide fastener of a reduced length. The foregoing cutting down process is performed manually and hence inefficient.

In view of the foregoing difficulties, it has been a strong desire to devise an automatized slide-fastener cutting down apparatus.

Such automatized apparatus is to be so constructed as to perform the following processing steps one after another: (a) Applying new top end stops to two opposed, partly separated stringers of a finished slide fastener to be processed, at a first position determined in view of the length of a desired slide fastener; (b) Severing two stringer tapes at a second position spaced forwardly (upstream) from the first position; and (c) Removing coupling elements disposed between the first and second positions. When the coupling-element removing step is carried out before the top end-stop applying step, a problem arises in that the slide fastener stringers must be replaced from an element severing unit to an end stop applying unit, lowering the efficiency of the cut-down apparatus as a whole. It is therefore preferable that the top end stop applying unit is disposed rearwardly (downstream) of the element severing unit so as to attach the top end stops concurrently with the removal of the coupling elements. Such arrangement is still unsatisfactory because one or more coupling elements located adjacent to the top end stops are sometimes left half-cut and drawn toward the opposite stringer when the relative position between the top end stops and such endmost coupling elements is changed. These half-cut, projecting coupling elements have sharp cut ends which are likely to damage other structural component parts of the slide fastener or the operator.

SUMMARY OF THE INVENTION

With the foregoing difficulties in view, it is an object of the present invention to provide an apparatus capable of cutting down a finished slide fastener efficiently without the ocurrence of half-cutting of the coupling elements.

According to the present invention, there is provided an apparatus for cutting down the length of a finished slide fastener, comprising a tape gripper for holding each stringer tape of the slide fastener from the opposite sides thereof, an element clamper for gripping coupling heads of a length of the coupling elements to be removed from each stringer tape, and also for deflecting the coupling heads in one direction while keeping the gripping of the coupling heads, and an element cutter responsive to the movement of the deflected coupling heads for cutting one of opposite legs of said length of coupling elements and also of several adjacent coupling elements disposed rearwardly of said coupling element length. A pilot pin is disposed immediately adjacent to a rear end of the element clamper for projecting between two adjacent coupling elements, the pilot pin being spaced from a rear end of the element cutter by a distance which is equal to the sum of the element pitch and at least a half of the diameter of the monofilament forming the row of coupling elements. A top end-stop applicator is disposed immediately adjacent to the rear end of the element cutter for applying a top end stop to the inner longitudinal edge of each stringer tape. A stopper is positionally adjustably disposed on a rear side of the top end-stop applicator and engageable with the bottom end stop for setting a length of reduction from the slide fastener. A tape cutter is disposed immediately adjacent to a front end of the element cutter for transversely severing each stringer tape.

With the apparatus thus constructed, the slide fastener stringers are positioned in a working station upon abutment of the bottom end stop with the stopper. After stringer tapes and the coupling heads are gripped, a length of the coupling elements are cut off and removed from the stringers. Then, two top end stops are applied to the respective stringers, and the stringer tapes are severed into a desired length.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

Figure 1:
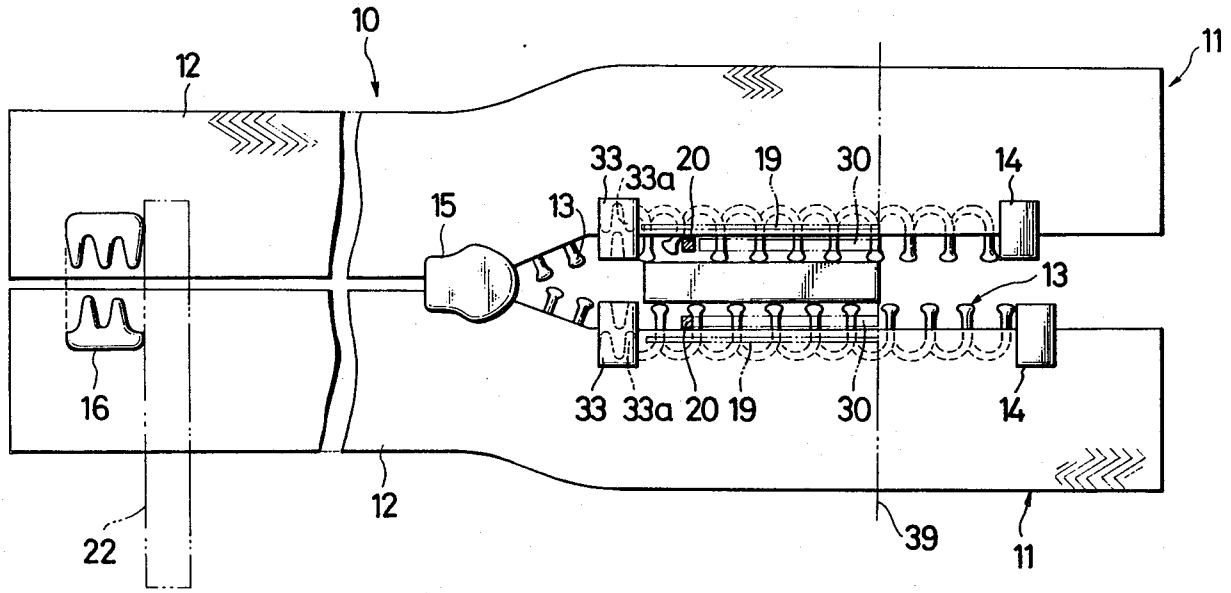
FIG. 1 is a bottom view of a finished slide fastener as it is about to be processed on an apparatus according to the present invention.

FIG. 1 shows a finished slide fastener 10 to be processed on an apparatus embodying the present invention. The slide fastener 10 includes a pair of slide fastener stringers 11, 11 each having a stringer tape 12 and a row of continuous helically-coiled coupling elements 13 mounted on and along an inner longitudinal edge of the stringer tape 12. The coiled coupling elements 13 are disposed on the front or face side of the stringer tapes 12. The slide fastener 10 further has a pair of top end stops 14, 14 attached to the respective stringer tapes 12 adjacent to an upper end (right end in FIG. 1) of a chain of two opposed rows of coupling elements 13, a slider 15 slidably mounted on the coupling element chain 13 for opening and closing the slide fastener 10, and a bottom end stop 16 attached to both stringer tapes 12 adjacent to a lower end (left end in FIG. 1) of the chain of coupling elements 13. The apparatus of the present invention effectively operates even in an application in which the slide fastener 10 has a separable bottom end stop (not shown) composed of a retainer pin mounted on one stringer tape and having a box-shaped retainer, and a separable pin mounted on the other stringer tape and receivable in the retainer to releasably connecting the two stringers 11, 11 at the bottom.

Before being processed on the apparatus, the slider 15 is moved toward the bottom end stop 16 until the two stringers 11 are partly separated over a length which is longer than the length to be cut-down or reduced. The partly separated slide fastener 10 is introduced into a working station in the apparatus in which the separated lengths of the stringers 11 extend parallel to one another with their front sides facing downwardly, as shown in FIG. 1. Then the apparatus is energized to process the slide fastener 10 in the manner as described later on. The illustrated apparatus is so constructed to process both stringers concurrently, but the present invention is not limited to the illustrated embodiment. Rather, it is possible to modify the apparatus such that the stringers 11 are processed separately. Since the apparatus is symmetric in construction relative to the longitudinal central line of the apparatus and a description given below refers to only one side of the apparatus. In the drawings, the same reference characters refer to the same or identical component parts throughout the several views.

Figure 2:
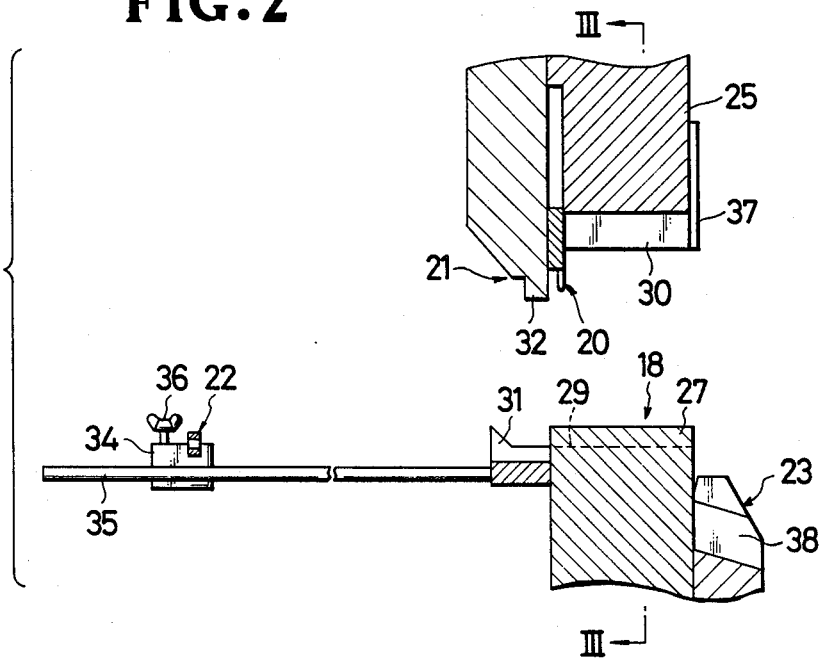
FIG. 2 is a vertical cross-sectional view of the apparatus.
Figure 3:
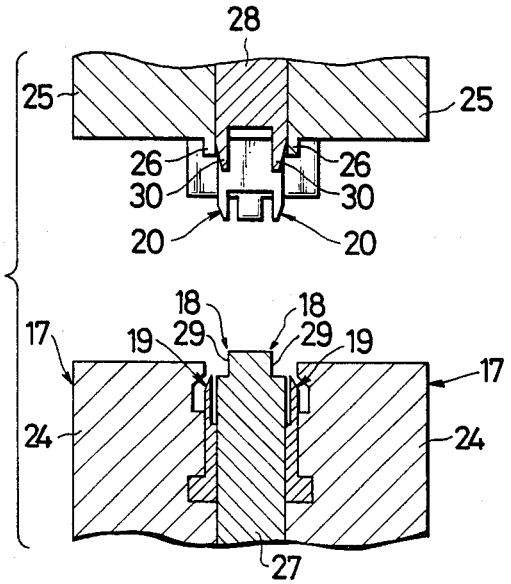
FIG. 3 is a transverse cross-sectional view taken along line III—III of FIG. 2.

As shown in FIGS. 2 and 3, the apparatus generally comprises a tape gripper 17, an element clamper 18, an element cutter 19, a pilot pin 20, a top end-stop applicator 21, a stopper 22, and a tape cutter 23.

The tape gripper 17 functions to grip the stringer tape 12 of one stringer 11 from the opposite sides thereof. To this end, the tape gripper 17 includes a fixed holder 24 and a movable holder 25 disposed above the fixed holder 24 and vertically reciprocable toward and away from the fixed holder 24 to grip a length of the stringer tape 12 between the two holders 24, 25. The movable holder 25 has a downwardly projecting ridge 26 engageable with an inner longitudinal edge of the stringer 12 for deflecting the same in a downward direction.

The element clamper 18 is disposed inwardly of the tape gripper 17 along the longitudinal central axis of the apparatus for gripping coupling heads **13*a* of the individual coupling elements 13 along a length thereof. The element clamper 18 includes a lower support block 27 and an upper presser block 28 vertically reciprocable toward and away from the support block 27 to grip the coupling heads 13*a* between the two block 27, 28. The support block 27 has a lateral recess 29 facing toward the fixed holder 24 for receiving therein at least the coupling heads 13*a*. The presser block 28 has a downwardly projecting presser foot 30 tapered on its one side so that the presser foot 30 is engageable with the coupling heads 13*a* without interference with the stringer tape 12. The support block 27 is vertically movable along with the presser block 28 in response to the downward movement of the presser block 28, as shown in FIG. 4C. The presser block 28 is lowered in synchronism with the downward movement of the movable holder 25. The element clamper 18 disposed on one side of the apparatus is integral with the element clamper 18 of the opposite side. The element clampers 18 have the same length as the coupling elements 13** to be removed.

The element cutter 19, as shown in FIG. 3, is vertically disposed between the fixed holder 24 of the tape gripper 17 and the support block 27 of the element clamper 18 and is secured to the fixed holder 24 for cutting upper legs **13*b* (FIG. 5A) of the coupling elements 13. The element cutter 19 has a cutting edge lying flush with the bottom surface of the recess 29 in the support block 27 when the support block 27 is disposed in its uppermost position shown in FIG. 3. The element cutter 19 is longer than the presser foot 30 to such an extent that the rear edge (left edge in FIG. 1) projects beyond the presser foot 13 by a distance which is several times larger than an inter-element space or pitch of the rows of coupling elements 13**.

The pilot pin 20 is disposed vertically against a recessed rear end wall of the movable holder 25 and projects downwardly beyond a lower end surface of the presser foot 30 so as to move into a space between adjacent coupling elements 13 before the coupling elements 13 are gripped by the element clamper 18. The positional relationship between the pilot pin 20 and the element cutter 19 constitutes an important structural feature of the present invention.

Figure 5A:
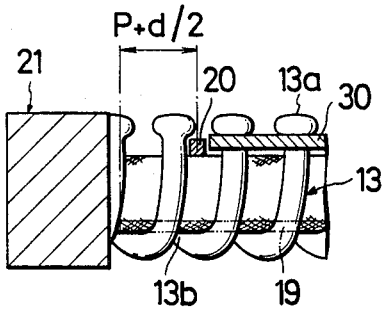
FIGS. 5A through 5C are enlarged horizontal cross-sectional views illustrative of the manner in which a pilot pin of the apparatus operates.

As shown in FIG. 5A, the pilot pin 20 is spaced rearwardly (righwardly in this figure) from the rear end of the element cutter 19 by a distance which is equal to the sum of the element pitch P and at least a half of the diameter d of a monofilament constituting the coiled coupling elements 13.

Figure 4A:
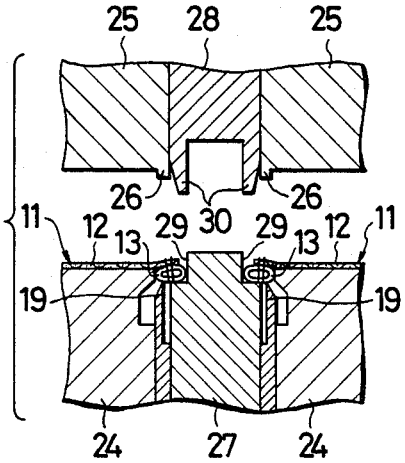
FIGS. 4A through 4C are views similar to FIG. 3, showing a sequence of operation of the apparatus.
Figure 4B:
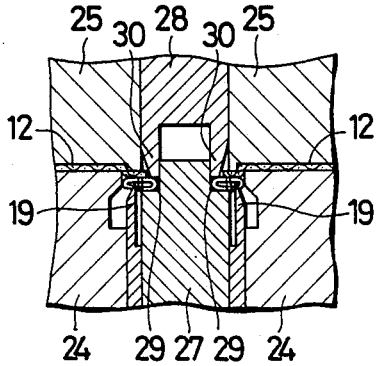
Figure 4C:
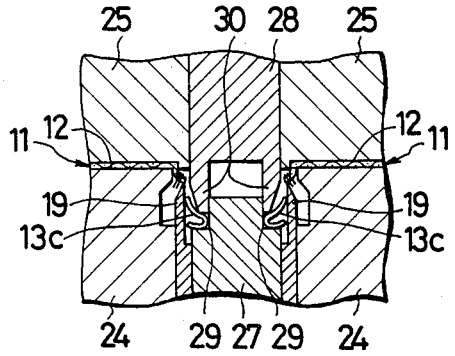

For better understanding of the importance of the aforesaid positioning of the pilot pin 20, the coupling-element removing operation of the apparatus is described first with reference to FIGS. 4A -4C. The fastener stringers 11, 11 are supported on the fixed holders 24 in parallel spaced relation to one another with their front sides facing downwardly while the coupling elements 13 are received in the lateral recesses 29 in the support block 27, as shown in FIG. 4A. Then the movable holders 25 and the presser block 28 are lowered concurrently toward the fixed holders 24 and the support block 27 to grip the stringer tapes 12 and the coupling elements 13 therebetween, as shown in FIG. 4B. The presser block 28 is further moved downwardly whereupon the coupling elements 13 are forced downwardly against the element cutters 19 while the coupling heads **13*a* of the coupling elements are being gripped between the presser and support blocks 28, 27**.

With this downward movement of the coupling elements 13 relative to the element cutter 19, the upper legs **13*b* of the coupling elements 13 are severed. As the presser and support blocks 28, 27 are further descended while holding the coupling heads 13 therebetween, the severed coupling elements 13 are removed from the stringers 11, as shown in FIG. 4C. Then the presser block 28 is moved upwardly and the removed coupling elements 13C** are discharged from the apparatus by means of air jet supplied from air nozzles (not shown).

Figure 5B:
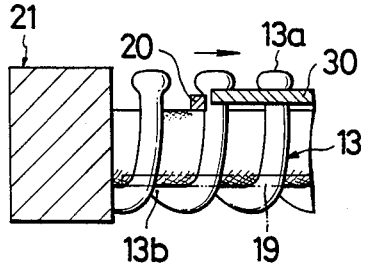
Figure 5C:
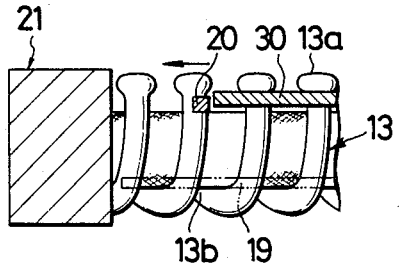
Figure 6:
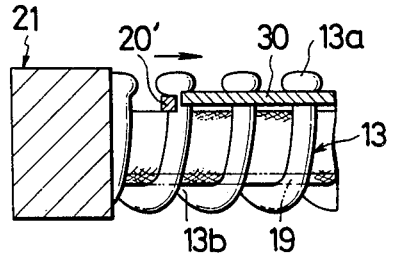
FIG. 6 is a view similar to FIG. 5A, but showing the function of the apparatus obtained when the pilot pin is spaced from the rear end of an element cutter at a different distance.

During the element removing operation described above, the pilot pin 20 may take three positions relative to the coupling elements 13 to be removed, as shown in FIGS. 5A -5C. In FIG. 5A, the pilot pin 20 is disposed between two ajacent coupling elements 13. In this condition, all the severed coupling elements 13 are removed smoothly as the presser foot 30 deflects the couplng heads 13*a* of the severed coupling elements 13. On the other hand, depending on the length of reduction from the slide fastener, the pilot pin 20 occasionally engages one of the coupling elements 13 to be severed, as shown in FIGS. 5B and 5C. On these occasions, if the spacing between the pilot pin 20 and the rear end of the element cutter 19 were shorter than the above-mentioned spacing (P+d/2) of the present invention, a smooth element removing operation would not be performed. Stated more specifically, when descended, the pilot pin 20' (having a shorter spacing between itself and the element cutter's rear end as shown in FIG. 6) engages one of the coupling elements 13 to be removed and then displaces the coupling element forwardly (rightwardly in this figure) into a path of movement of the presser foot 30 before the engagement of the presser foot 30 with the coupling elements 13. The coupling elements 13 including the displaced one are firmly gripped between the presser foot 30 of the presser block 28 and the non-illustrated recessed portion 29 of the support block 27. As the presser and support blocks 27, 28 further descend, the gripped coupling elements 13 are forced downwardly against the element cutter 19. Thus, the coupling elements 13 are severed at their upper legs 13*b* (lower legs in the figure). A further downward movement of the presser foot 30 causes the severed coupling elements 13 to be removed from the stringer tape 12 except the displaced coupling element. Since the lower leg (shown on the upper side in the figure) of the displaced coupling element 13 is connected with the lower leg of an endmost coupling element 13 disposed adjacent to the top end-stop applicator 21, the displaced coupling element 13 still remains on the stringer tape 12 in a half-cut state, and the half-cut, displaced coupling element 13 is drawn in a lateral direction away from the inner tape edge. The coupling element thus drawn or projecting has a sharp cut edge and hence is harmful and sometimes damages the other components of the slide fastener or the operator.

The foregoing difficulty will never occur when the spacing between the pilot pin 20 and the rear end of the element cutter 19 is set in the value of P+d/2 where P is the element pitch and d is the diameter of the monofilament, as described above. In case the pilot pin 20 engages one coupling element 13 on its rear side, the coupling element 13 is displaced forwardly in a direction indicated by the arrow in FIG. 5B. The displaced coupling element 13 is gripped, then severed and finally removed from the stringer tape 12 since the coupling element 13 which is disposed rearwardly next to the displaced coupling element 13 is severed on its upper leg. In an another alternative case, the pilot pin 20 engages one coupling element 13 on its front side as shown in FIG. 5C. The coupling element 13 is displaced by the pilot pin 20 rearwardly in the direction of the arrow away from the path of movement of the presser foot 30. After severance of the coupling elements including the displaced one, the displaced coupling element 13 still remains on the stringer tape 12 as it has not been subjected to downward pressure of the presser foot 30. It is therefore necessary to manually remove the thus remaining coupling element 13. However, an objectionable draw of the half-cut coupling element can be avoided.

The top end-stop applicator 21, as shown in FIG. 2, is immediately downstream of the element clamper 18 and includes a fixed die 31 secured to the fixed holder 24 of the tape gripper 17, and a movable punch 32 disposed adjacent to the presser block 28 and the movable holder 25 and vertically movable toward and away from the die 31 in synchronism with the movement of the movable holder 25. To the top end-stop aplicator 21, a strip of metal (not shown) is supplied in a transverse direction. The metal strip is then cut-off into a U-shaped end-stop blank having prongs 33*a* on its opposite ends. The end-stop blank is then clinched around the inner edge of the stringer tape 12 by and between the punch and die 32, 31. Thus, a new top end stop 33 is provided on the stringer 11. The top end-stop applicator 21 may be the same in construction as the applicator disclosed in Japanese Patent Publication No. 57-61409.

The stopper 22, as shown in FIG. 2, is supported on a mounting block 34 slidably mounted on a horizontal guide bar 35 extending rearwardly (leftwardly in this figure) from the fixed holder 24 of the tape gripper 17. The stopper 22 has a U-shape and extends perpendicular to the axis of the guide bar 35 so that the stringer tape 11 is supported between two opposed arms of the U-shaped stopper 22 when the bottom end stop 16 is held in abutment with the stopper 22. The mounting block 34 is secured by a lock screw 36 to the guide bar 35 but is positionally adjustable while the lock screw 36 is loosened. Though not shown, the guide bar 35 has on its peripheral surface a scale for setting the position of the stopper 22 relative to the working station in conformity of the length of a desired slide fastener. In positioning the slide fastener, a slide fastener stringer 11 is laterally inserted in the U-shaped stopper 22 and pulled in a longitudinal direction toward the working station until the bottom end stop 16 abuts on the stopper 22, as shown in FIG. 1.

The tape cutter 23, as shown in FIG. 2, is disposed immediately upstream of the tape gripper 17 and the element clamper 18 and includes a pair of upper and lower cutting blades 37, 38 relatively movable toward and away from each other to sever the stringer tape 12 along a transverse line of severance 39 (FIG. 1). The movable blade 37 is secured to the movable holder 24.

In operation, the slide fastener stringers 11 of a finished slide fastener 10 is set in the working station of the apparatus with it front side facing downwardly. Then, the upper components of the apparatus, namely, the movable holders 25, the presser blocks 28, the pilot pins 20, the punchs 32 and the upper blades 37 are lowered substantially at the same time to perform, within a relatively short period of time, the steps of severing the coupling elements 13, removing the severed coupling elements 13, applying the new top end stops 33 and severing the stringer tapes 12, thereby producing a new slide fastener of the desired reduced length. Due to the provision of the pilot pins 20 at the predetermined intervals from the rear ends of element cutters 19, the foregoing processing steps can be achieved smoothly without causing an undesired draw of half-cut coupling elements.

Obviously, many modifications and variations of the present invention are possible in the light of the above teachings. It is therefore to be understood that within the scope of the appended claims, the invention may be practiced otherwise than as specifically described.

What is claimed is:

1. An apparatus for cutting down the length of a finished slide fastener including a pair of stringers each having a stringer tape and a row of continuous helically-coiled coupling elements mounted on one side of each stringer tape along an inner longitudinal edge thereof, a pair of top end stops mounted on the stringer tapes, respectively, adjacent to one end of the two rows of coupling elements, and a bottom end stop mounted on both stringer tapes adjacent to the opposite end of the rows of coupling elements, the row of coupling elements being made of a monofilament and having an element pitch, each of the coupling elements having a coupling head, said apparatus comprising:

(a) a tape gripper for holding each stringer tape from the opposite sides thereof;

(b) an element clamper for gripping coupling heads of a length of the coupling elements to be removed from each stringer tape, and also for deflecting the coupling heads in one direction while keeping the gripping of the coupling heads;

(c) an element cutter responsive to the movement of the deflected coupling heads for cutting one of opposite legs of said length of coupling elements and also of several adjacent coupling elements disposed rearwardly of said coupling element length;

(d) a pilot pin disposed immediately adjacent to a rear end of said element clamper for projecting between two adjacent coupling elements, said pilot pin being spaced from a rear end of said element cutter by a distance which is equal to the sum of the element pitch and at least a half of the diameter of the monofilament;

(e) a top end-stop applicator disposed immediately adjacent to said rear end of said element cutter for applying a top end stop to the inner longitudinal edge of each stringer tape;

(f) a stopper positionally adjustably disposed on a rear side of said top end-stop applicator and engageable with the bottom end stop for setting a length of reduction from the slide fastener; and (g) a tape cutter disposed immediately adjacent to a front end of said element cutter for transversely severing each stringer tape.

2. An apparatus according to claim 1, said tape gripper, said element clamper, said element cutter, said pilot pin and said tape cutter being operative substantially at the same time.

3. An apparatus according to claim 1, said tape gripper including a fixed holder and a movable holder disposed above said fixed holder and vertically reciprocable toward and away from said fixed holder for gripping the stringer tape therebetween, said element cutter being secured to said fixed holder, said element clamper including a support block for supporting thereon said length of coupling elements, and a presser block disposed above said support block and vertically reciprocable toward and away from said support block for gripping said coupling heads, said support block being vertically movable together with said presser block.

4. An apparatus according to claim 1, said stopper having a U-shape and supporting the stringer tape between opposed arm of said U-shaped stopper when the bottom end stop is held in abutment with said stopper.

5. An apparatus according to claim 1, further including a horizontal guide block extending reawardly from said top end-stop applicator, and a mounting block slidably mounted on said guide block and supporting thereon said stopper.

* * * * *